US005503310A

United States Patent [19]

Zuckerman et al.

[11] Patent Number: 5,503,310

[45] Date of Patent: *Apr. 2, 1996

[54] COMBINATION INDICATOR AND GARMENT HANGER

[75] Inventors: Andrew M. Zuckerman, Forest Hills, N.Y.; John W. Havrilla, Akron, Ohio

[73] Assignee: Different Dimensions, Inc., Rego Park, N.Y.

[ * ] Notice: The portion of the term of this patent shall not extend beyond the expiration date of Pat. No. 5,377,884.

[21] Appl. No.: 289,858

[22] Filed: Aug. 12, 1994

Related U.S. Application Data

[63] Continuation-in-part of Ser. No. 238,176, May 4, 1994, abandoned, which is a continuation-in-part of Ser. No. 130,623, Oct. 1, 1993, Pat. No. 5,377,884.

[51] Int. Cl.[6] ..... A47G 25/14

[52] U.S. Cl. ..... 223/85; 40/322

[58] Field of Search ..... 223/85, 88, 92, 223/95; 40/322; D6/315

[56] References Cited

U.S. PATENT DOCUMENTS

| | | |
|---|---|---|
| D. 244,197 | 5/1977 | Ostroll . |
| D. 264,912 | 6/1982 | Bliss et al. . |
| D. 302,214 | 7/1989 | Wilson . |
| D. 303,325 | 9/1989 | Marshall . |
| 2,074,841 | 3/1937 | Haimowitz . |
| 2,099,596 | 11/1937 | Bruening . |
| 2,288,071 | 6/1942 | Cohen . |
| 2,658,627 | 11/1953 | Magnuson . |
| 3,024,953 | 3/1962 | O'Keefe . |
| 3,685,189 | 8/1972 | Conger . |
| 3,949,914 | 4/1976 | Ostroll . |
| 4,006,547 | 2/1977 | Samuels et al. . |
| 4,115,940 | 9/1978 | Phillips . |
| 4,137,661 | 2/1979 | Johansson . |
| 4,322,902 | 4/1982 | Lenthall . |
| 4,450,639 | 5/1984 | Duester . |
| 4,714,156 | 12/1987 | Kolton et al. . |
| 4,886,195 | 12/1989 | Blanchard . |
| 5,096,101 | 3/1992 | Norman . |
| 5,377,884 | 1/1995 | Zuckerman ..... 223/85 |

FOREIGN PATENT DOCUMENTS

| | | |
|---|---|---|
| 5598880 | 12/1977 | Australia . |
| 4231878 | 12/1978 | Australia . |
| 5701180 | 3/1980 | Australia . |
| 8304122 | 11/1983 | Australia . |
| 556252 | 3/1992 | Australia . |
| 518708 | 3/1972 | Switzerland . |
| WO9009651 | 8/1990 | WIPO . |

*Primary Examiner*—C. D. Crowder
*Assistant Examiner*—Bibhu Mohanty
*Attorney, Agent, or Firm*—Amster, Rothstein & Ebenstein

[57] ABSTRACT

In combination, a hanger for garments and other articles and a separately formed indicator secured to the hanger for indicating information associated with the garments and other articles, the hanger defining a hook adapted to engage a rail or other structure, and the hook in turn defining a support for receiving and engaging the indicator, the indicator including a hollow four-sided body defining an open top, an open bottom, a generally parallel pair of opposed sides, and a generally parallel pair of opposed ends connecting the sides, each side having a generally planar unapertured side surface and each end having sufficient surface area for displaying information thereon. The opposed sides having respective inner surfaces, at least one of which is formed so as to interlock with the support of the hanger.

16 Claims, 10 Drawing Sheets

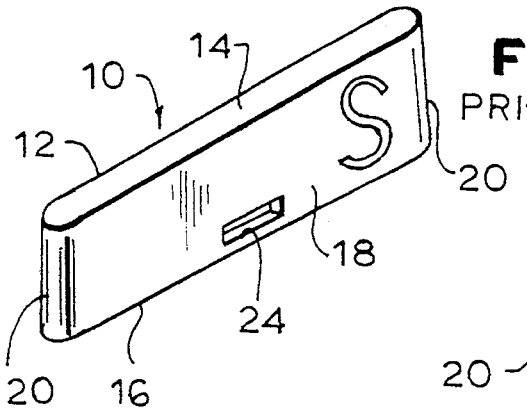
FIG.1
PRIOR ART
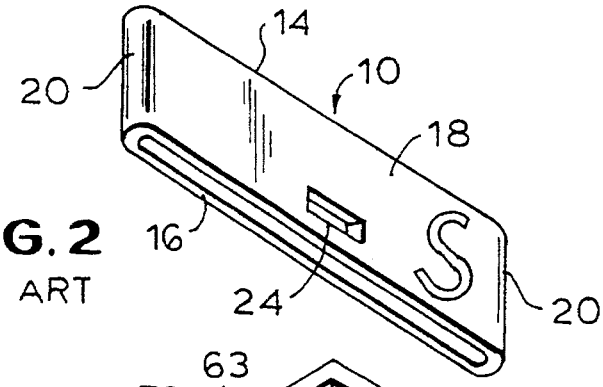
FIG.2
PRIOR ART
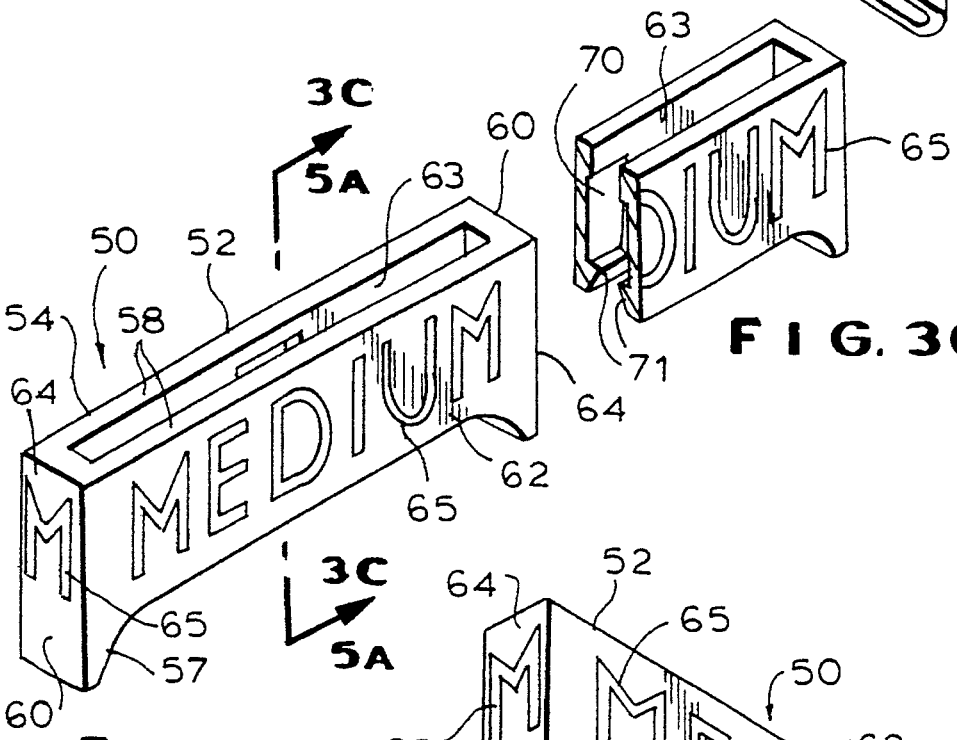
FIG.3C
FIG.3A
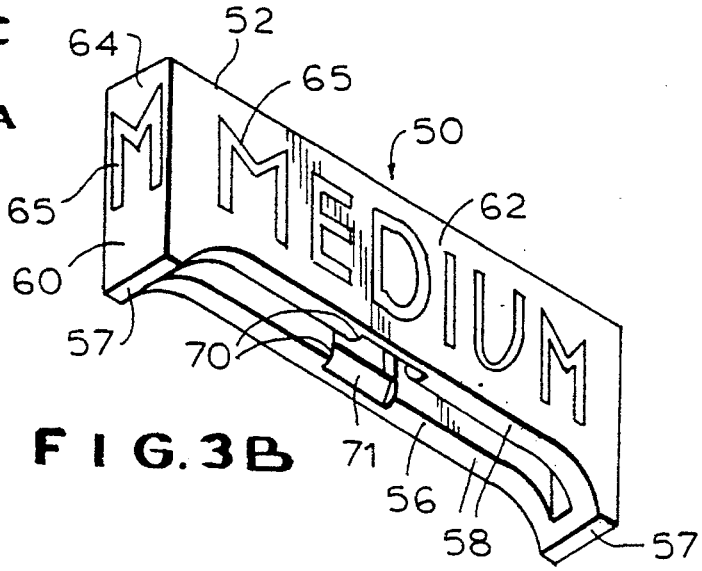
FIG.3B FIG. 4A
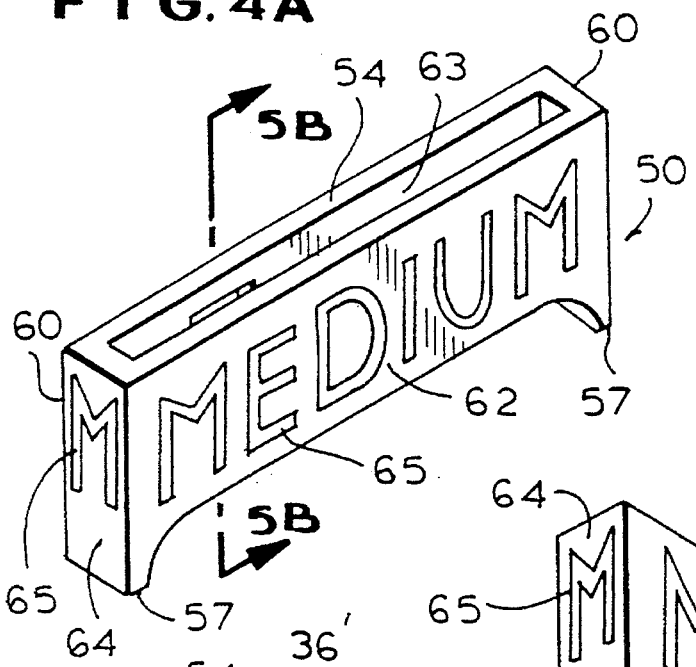
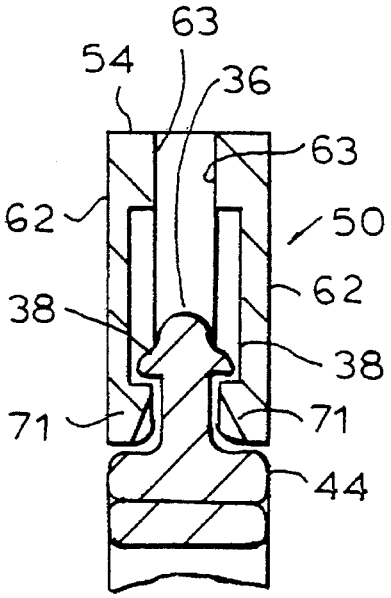
FIG. 5A
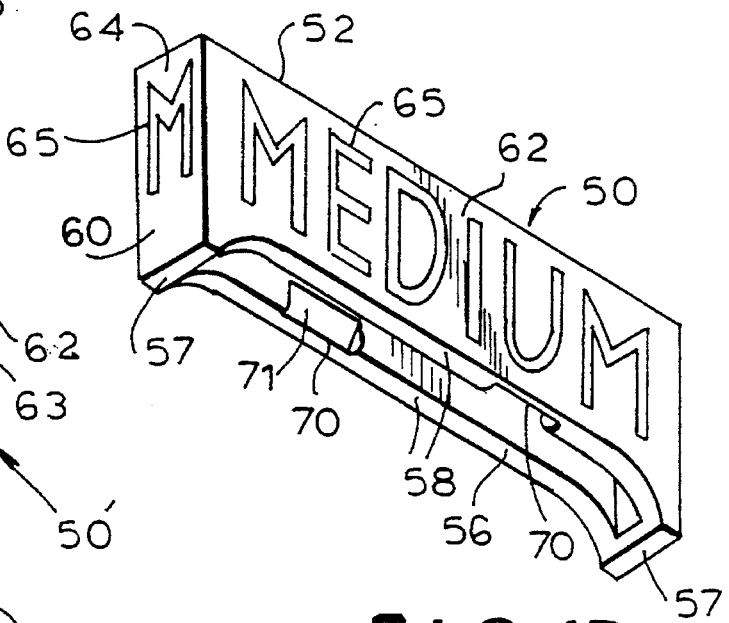
FIG. 4B
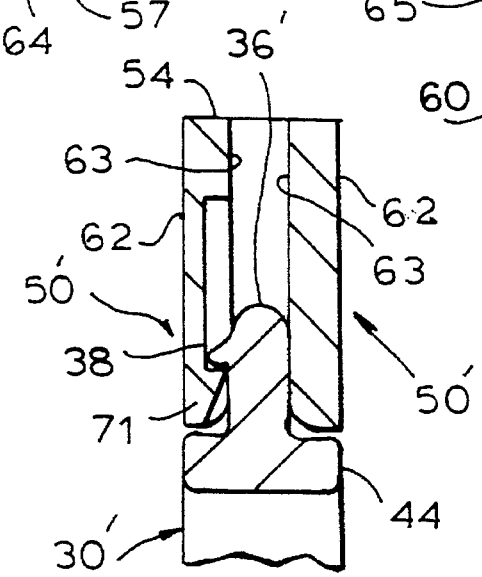
FIG. 5B FIG.7A
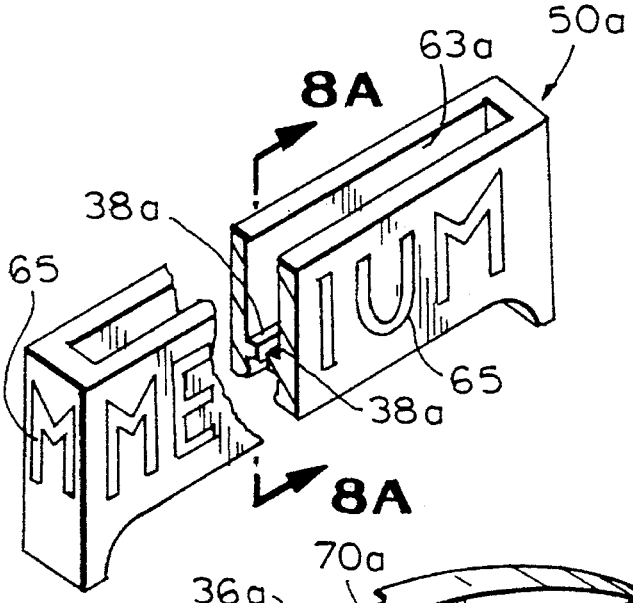
FIG.8A
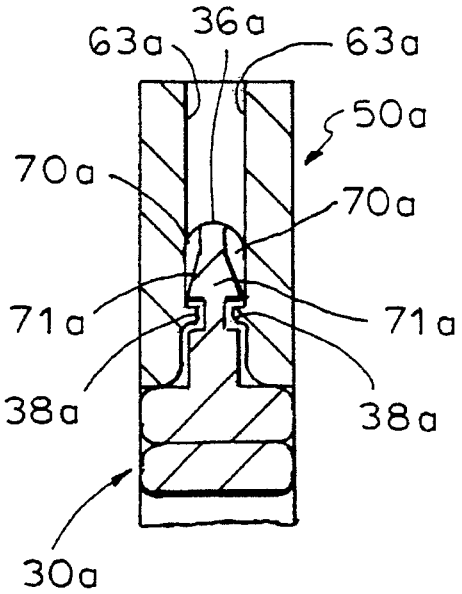
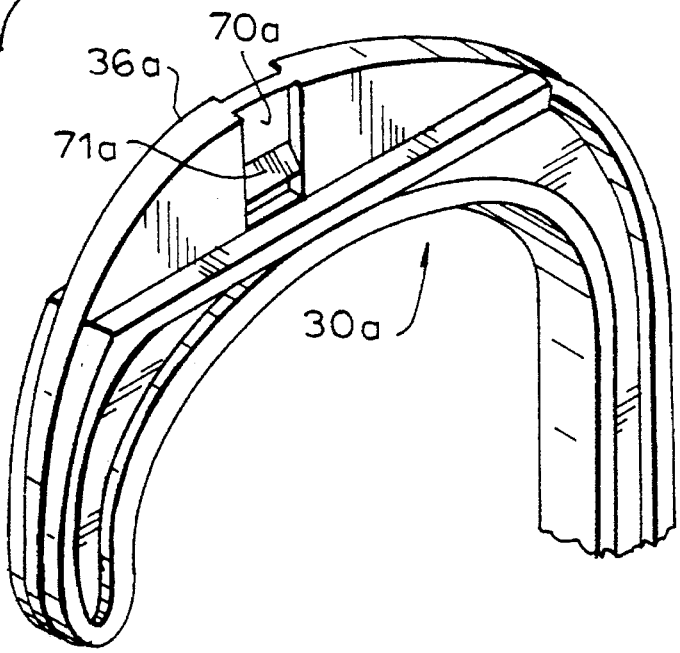
FIG.9A FIG. 7B
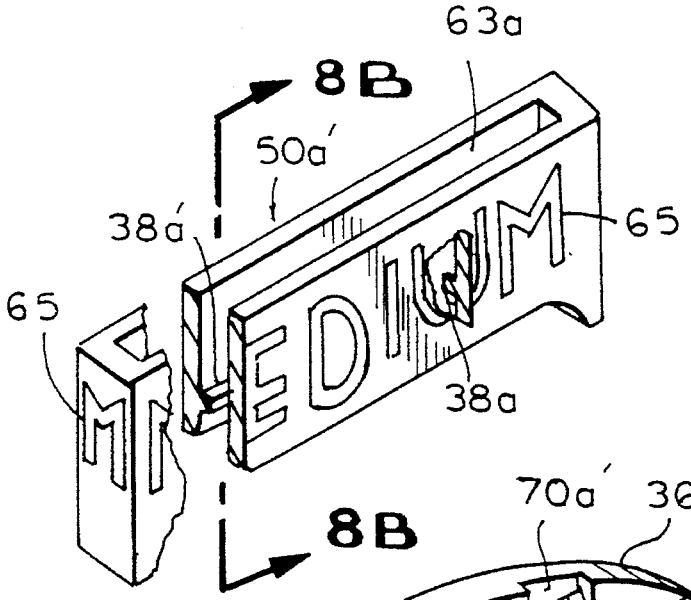
FIG. 8B
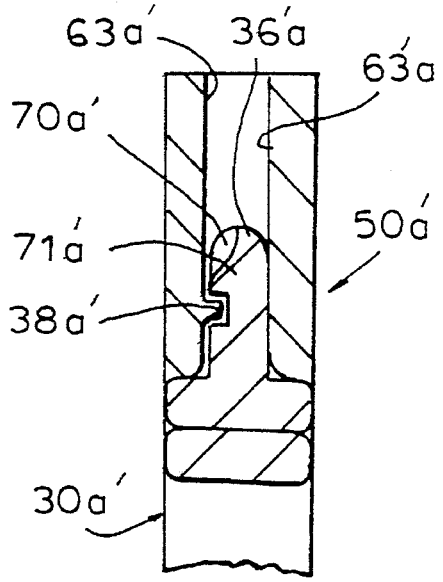
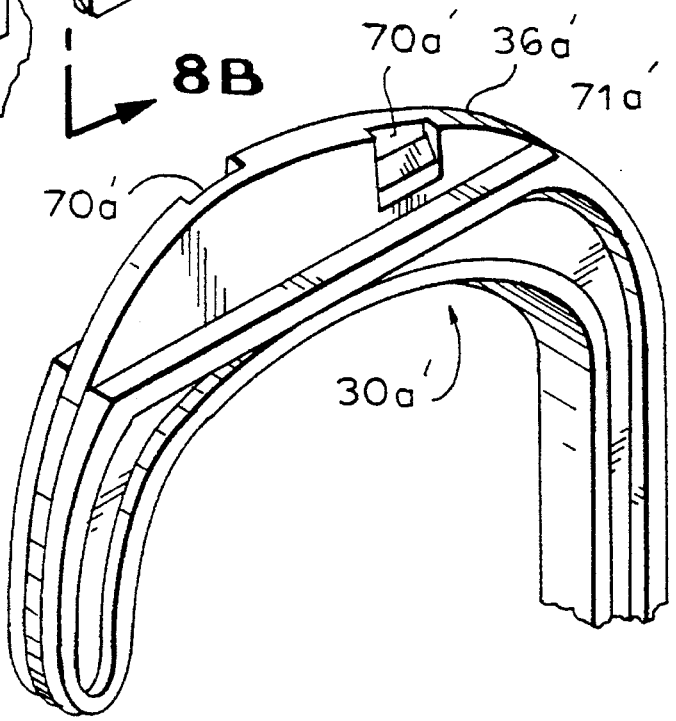
FIG. 9B FIG. 19
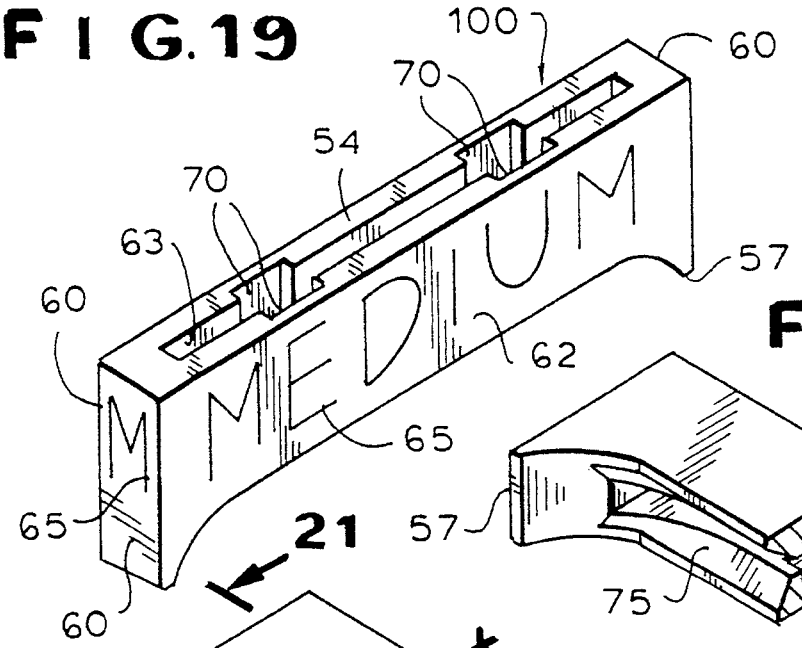
FIG. 22
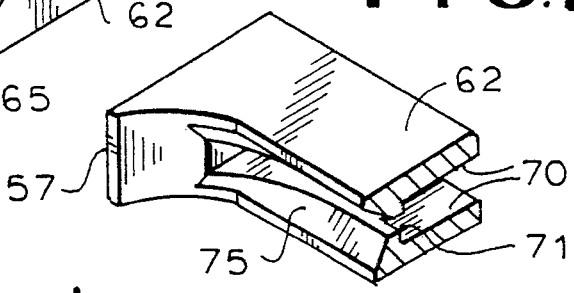
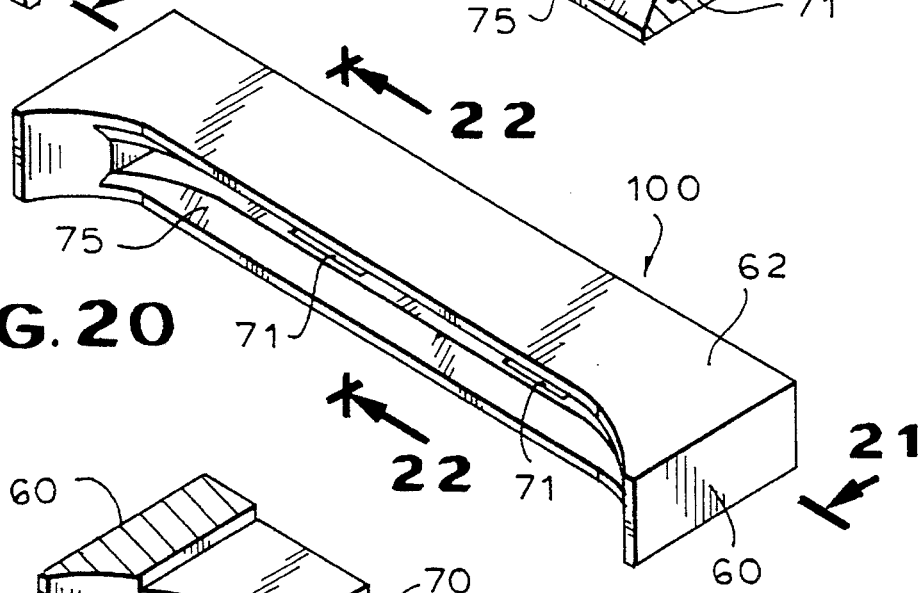
FIG. 20
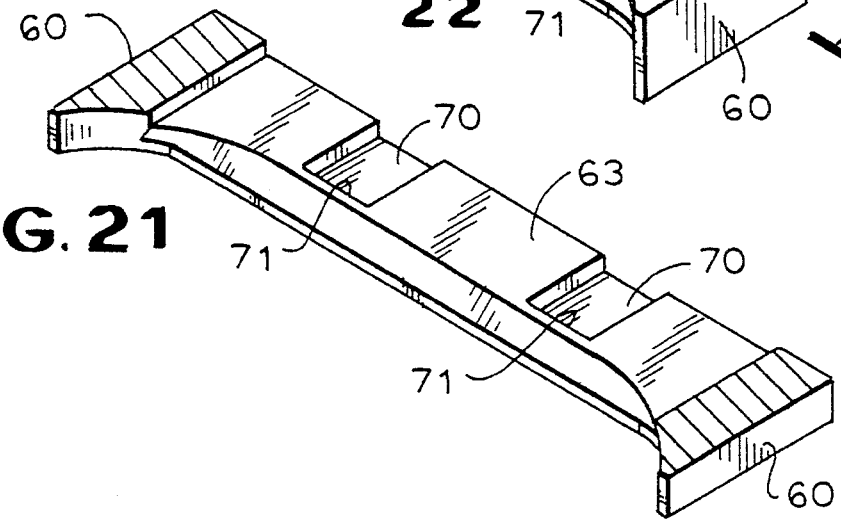
FIG. 21

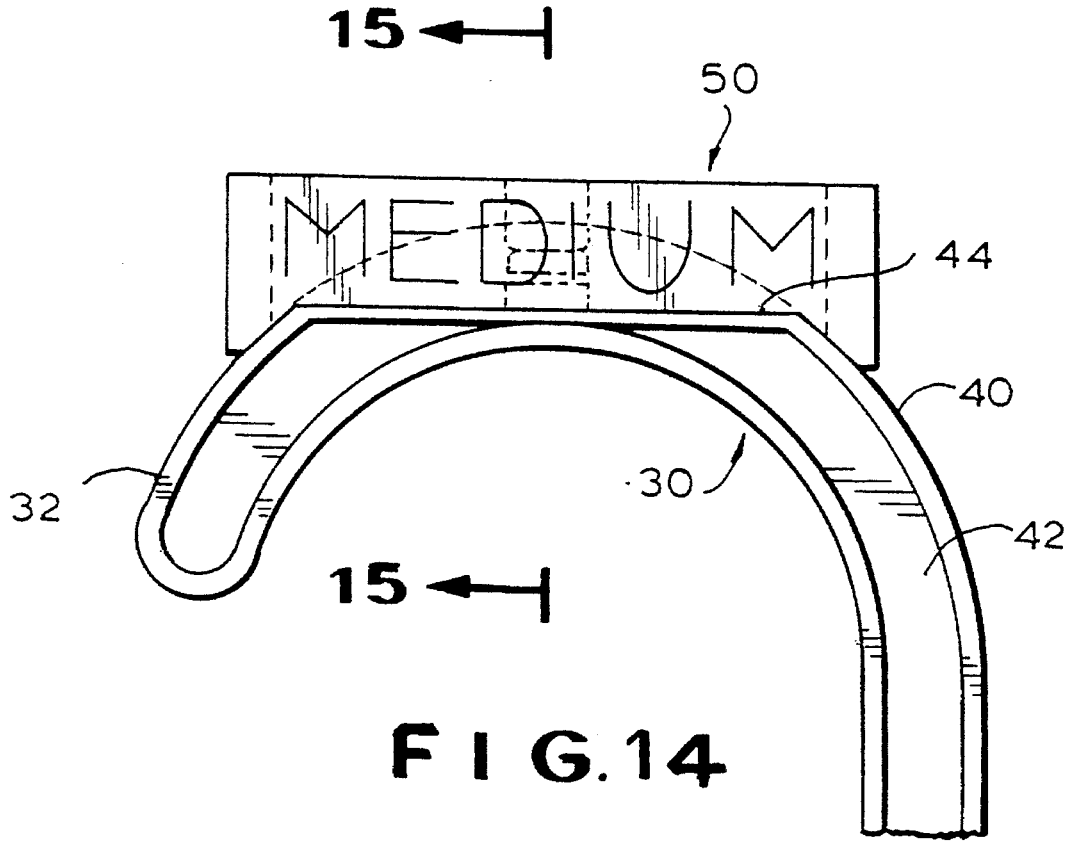
FIG. 14
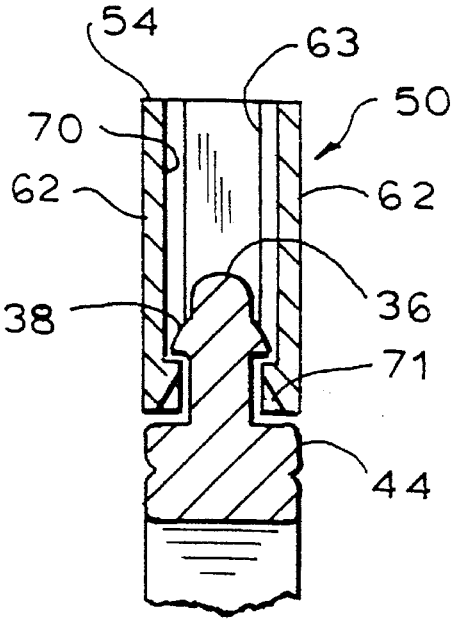
FIG. 15
FIG. 23B
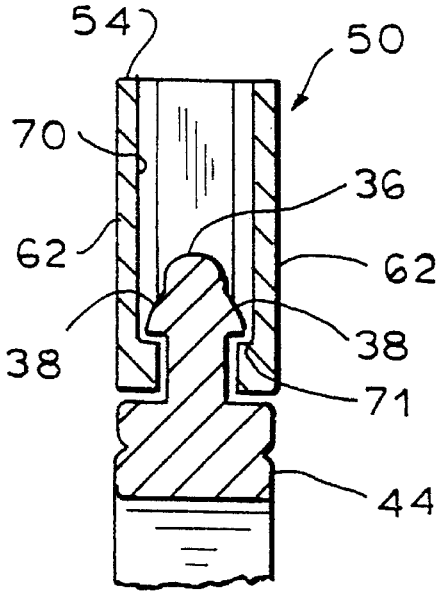

COMBINATION INDICATOR AND GARMENT HANGER

This Application is a Continuation-In-Part of U.S. patent application Ser. No. 08/238,176, now abandoned filed on May 4, 1994, which is a Continuation-In-Part of U.S. patent application Ser. No. 08/130,623, filed on Oct. 1, 1993, now U.S. Pat. No. 5,377,884.

BACKGROUND OF THE INVENTION

The present invention relates to hangers for garments and other articles in combination with a separately formed indicator secured to a hanger for indicating information associated with the articles, and more particularly to an improved indicator having internally disposed retaining means for ensuring secure engagement with the hanger.

When garments and other articles are displayed in retail stores on hangers, it is essential that the customer be provided with readily ascertainable information associated with the garments or articles, such as the size, manufacturer, price and the like. It is well known in the art to provide hangers with tabs or other indicators which either rest on the shoulder of the hanger or in the space between the shoulder of the hanger and the lower portion of the hook used to support the hanger on a rail, rack or like supporting element. It has been found that these tabs or indicators are not entirely satisfactory and have drawbacks. For example, when displayed on the supporting element, such hangers are typically disposed immediately adjacent one another such that the tabs can be at least partially obscured or concealed by clothing carried on adjacent hangers. Thus, the information may be difficult or even impossible to see until the hanger is removed from the rail.

An example of a prior art indicator/hanger combination is disclosed in U.S. Pat. No. 4,322,902, which teaches an indicator disposed on the top of the hook of the hanger. The indicator is formed having a hollow four-sided body defining a narrow open top, a wide open bottom, a pair of opposed sides and a pair of opposed ends connecting the sides. The sides define inwardly extending beads which are engaged by outwardly extending flanges at the top of the hook to preclude accidental dislodgment of the indicator from the hanger. A tool is used to force the sides of the indicator apart until the beads no longer engage the flanges. The indicator is then slid upwardly for removal from the hook.

FIGS. 1 and 2 show a commercial indicator 10 which is also adapted to fit on the top of the hook of a hanger. It has a hollow four-sided body 12 defining a closed top 14, an open bottom 16, a generally parallel pair of opposed sides 18, and a generally parallel pair of opposed ends 20 connecting the sides. The indicator is very thin which limits the area available for displaying the information (typically in the form of engraved letters or numbers) to only on the sides thereof, and not on the ends thereof since the ends are too small and rounded for this purpose. Each side of the top of the hanger on which the indicator 10 is used defines an outwardly extending boss which is received within a respective aperture 24 in each side of the indicator 10 to lock the indicator onto the hanger.

The indicator 10 has not proven to be entirely satisfactory in use as the sides of the indicator (which are the only portions of the indicator which bear information) are typically concealed in their entirety by the sides of the indicators of adjacent hangers when grouped together on a common rail. Thus, the information is not readily viewable until the hanger is removed from the rail. Even then, the amount of information that can be printed or engraved on the sides is limited because of the apertures 24. To remedy this defect, the height of the indicator may be increased to provide more printing surface. However, this is often undesirable or unworkable in view of the available clearances of the machines used to handle hangers. If the indicator is too tall (e.g., like that shown in U.S. Pat. No. 4,322,902), it cannot be used with conventional hanger handling machines since it will not fit them.

Accordingly, it is an object of the present invention to provide an indicator and hanger combination wherein the indicator is readily visible to customers by virtue of its position on the hook of the hanger.

It is another object of the present invention to provide such a combination wherein the information regarding the garments and other articles is disposed both on the side and end surfaces of the indicator for optimum visibility, even when the hanger is on a rack with like hangers disposed on either side thereof.

A further object of the present invention is to provide an indicator having integral provisions for ensuring proper orientation of the indicator when installed on the hanger.

It is yet another object of the present invention to provide such a combination wherein the indicator is securely attached to the hanger in such a manner as to resist inadvertently breaking loose.

It is still a further object of the present invention to provide such a combination wherein the indicator includes a plurality of staggered retaining means for attachment to the hanger in such a manner as to minimize rotation of the indicator relative to the hanger when disposed in a secured orientation.

It is yet another object to have an indicator with sides free of apertures to increase available space for information to be displayed thereon.

It is still another object of the present invention to provide such a combination which is inexpensive to manufacture and maintain, and may be used with conventional automated hanger handling equipment.

SUMMARY OF THE INVENTION

It has now been found that the above and related objects of the present invention are obtained by, in combination, a hanger for garments and other articles and a separately formed indicator secured to the hanger for indicating information associated with the garments and other articles. The hanger defines a hook adapted to engage a rail or other structure where the hook includes a support for receiving and also includes means for engaging the indicator.

The indicator is receivable on the support and includes a hollow four-sided body defining an open bottom, a generally parallel pair of opposed sides, and a generally parallel pair of opposed ends connecting the sides. Each side has a generally planar, unapertured outer side surface and an inner side surface, and each end has a generally planar end surface of sufficient width to have information displayed thereon. Typically each of the planar side surfaces and each of the planar end surfaces faces outwardly of the indicator and bears thereon information associated with the article, the information being printed on or molded onto the planar side and end surfaces. In this connection, coded information capable of being scanned by a bar code scanner or like apparatus can be applied to the side and/or end surfaces to facilitate automated handling of hangers with garments or to enable inventory to be taken. At least one of the inner side surfaces includes means for interlocking with the engaging means of the hanger hook.

In the first and second embodiments, the engaging means define at least one boss projecting outwardly from each opposed side of the supporting means of the hook, and the inner side surfaces of each side of the indicator define a corresponding recess for receiving and shelf for interlocking with the respective boss projecting outwardly from the supporting means of the hook. In the first embodiment, the bosses are respectively and centrally disposed on the opposed sides of the hook. In the second embodiment, the respective bosses are longitudinally disposed on the opposite sides of the hook along the length of the hook in non-opposing relation. As an option, to prevent the indicator from being installed on the hanger upside down, the recesses in the indicator walls are shorter in length than the height of the indicator body.

In third and fourth embodiments of the invention, the recess and associated shelf are defined in at least one side of the hook of the hanger. A corresponding boss protruding inwardly from at least one of the inner side surfaces of the sides of the indicator interlocks with the respective shelf of the hanger to secure the indicator to the hanger. As in the first and second embodiments, the respective recesses, shelves, and bosses may be disposed in opposing relation (i.e., the third embodiment) or in non-opposing relation (i.e., the fourth embodiment).

BRIEF DESCRIPTION OF THE DRAWINGS

FIGS. 1 and 2 are isometric views of a prior art indicator;

FIGS. 3A and 3B are isometric views of a first embodiment of an indicator in accordance with the present invention, respectively from the top, front and left side, and from the bottom, front and left side thereof;

FIG. 3C is an isometric sectional view along lines 3C—3C in FIG. 3A showing the configuration of the slots and associated shelves, for interlocking the indicator to the support of the hanger;

FIGS. 4A and 4B are isometric views of a second embodiment of an indicator in accordance with the present invention, respectively from the top, front and left side, and from the bottom, front and left side thereof;

FIG. 5A is a sectional view along lines 5A—5A in FIG. 3A showing the indicator of FIGS. 3A and 3B secured to the support of the hanger;

FIG. 5B is a sectional view along lines 5B—5B in FIG. 4A showing the indicator of FIGS. 4A and 4B secured to the support of the hanger;

FIG. 7A is an isometric view of a third embodiment of the invention wherein the indicator has a pair of centrally disposed bosses protruding inwardly for engagement with a hanger of the type shown in FIG. 9A;

FIG. 8A is a sectional view along lines 8A—8A in FIG. 7A showing the indicator of FIG. 7A installed on the hanger of FIG. 9A;

FIG. 9A is an isometric view of a third hanger embodiment;

FIG. 7B is an isometric view of a fourth embodiment of the invention wherein the indicator has a pair of bosses disposed transversely in non-opposing relation for engagement with a hanger of the type shown in FIG. 9B;

FIG. 8B is a sectional view along lines 8B—8B in FIG. 7B showing the indicator of FIG. 7B installed on the hanger of FIG. 9B;

FIG. 9B is an isometric view of a fourth hanger embodiment;

FIG. 12B is an isometric sectional view of the arrangement shown in FIG. 12A with an extended lead-in;

FIG. 14 is a plan view of the indicator of FIGS. 10'14 installed on a hanger;

FIG. 15 is a sectional view along lines 15—15 in FIG. 14 showing the indicator secured to the support of the hanger;

FIGS. 19 and 20 are isometric views of an indicator in accordance with the second embodiment having open-ended recesses disposed on tapered, opposed inner side surfaces, respectively from the top, front and left side and from the bottom, front and left side thereof;

FIG. 21 is an isometric sectional view along lines 21—21 in FIG. 20;

FIG. 22 is an isometric sectional view along lines 22—22 in FIG. 20;

FIG. 23B is a sectional view along lines 23B—23B of the indicator shown in FIG. 23A installed on the support of a hanger.

DETAILED DESCRIPTION OF THE PREFERRED EMBODIMENTS

Referring now to several views of the drawings, there is depicted a combination hanger 30 and indicator 50 for garments and other articles.

Figure 6A:
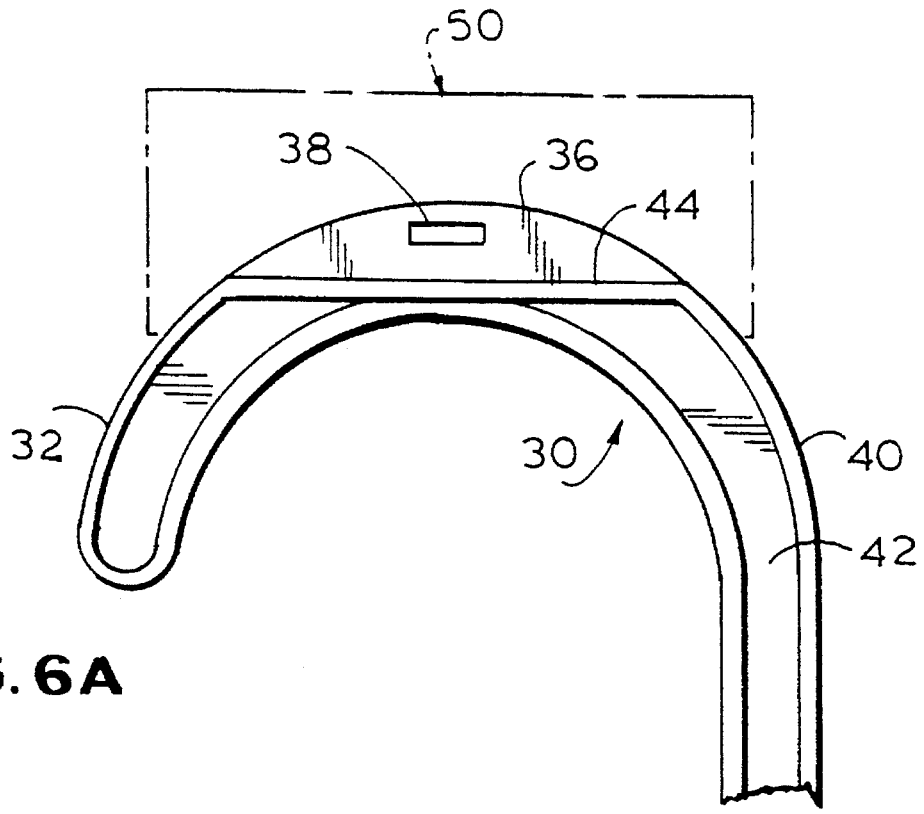
FIGS. 6A and 6B are plan views of hangers for use with the respective first and second indicator embodiments.
Figure 6B:
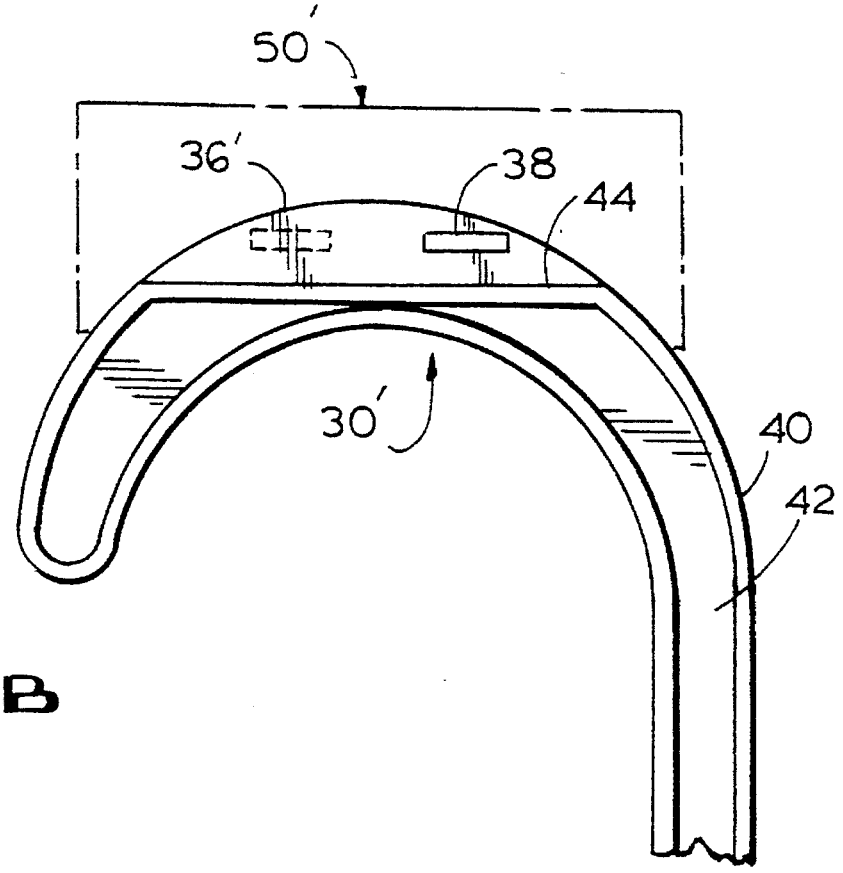
Figure 10:
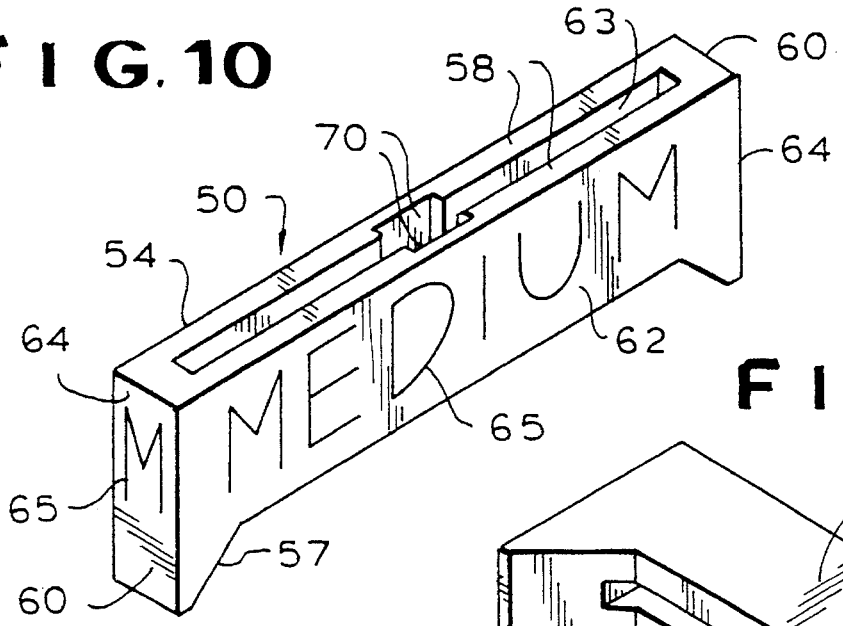
FIGS. 10 and 11 are isometric views of an indicator in accordance with the first embodiment having open-ended recesses, respectively from the top, front and left side and from the bottom, front and left side thereof.
Figure 11:
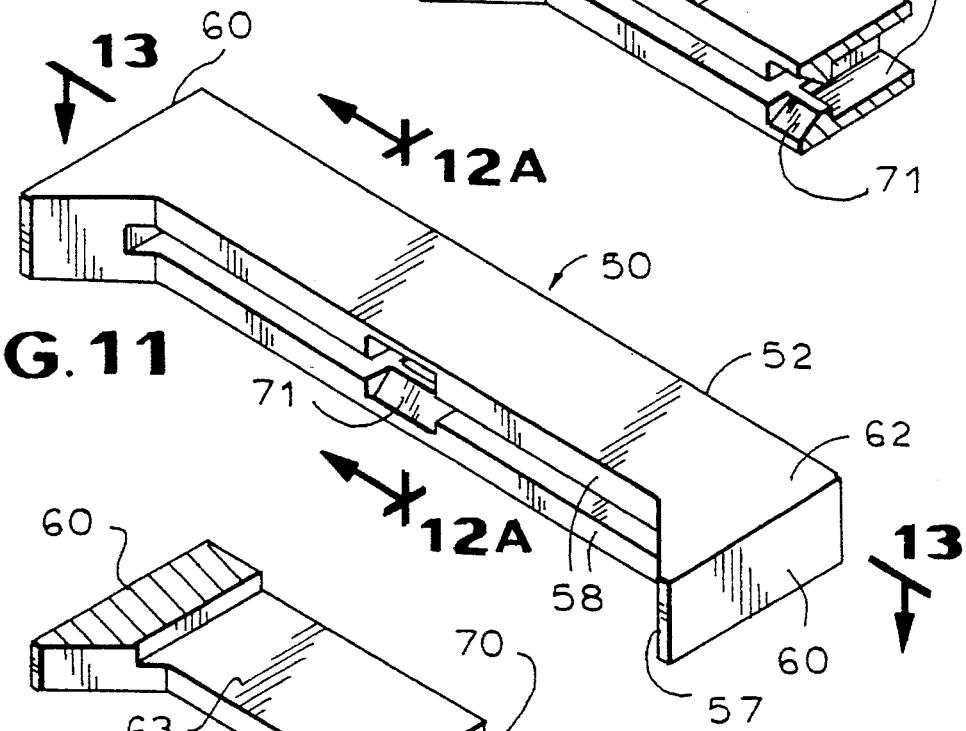
Figure 13:
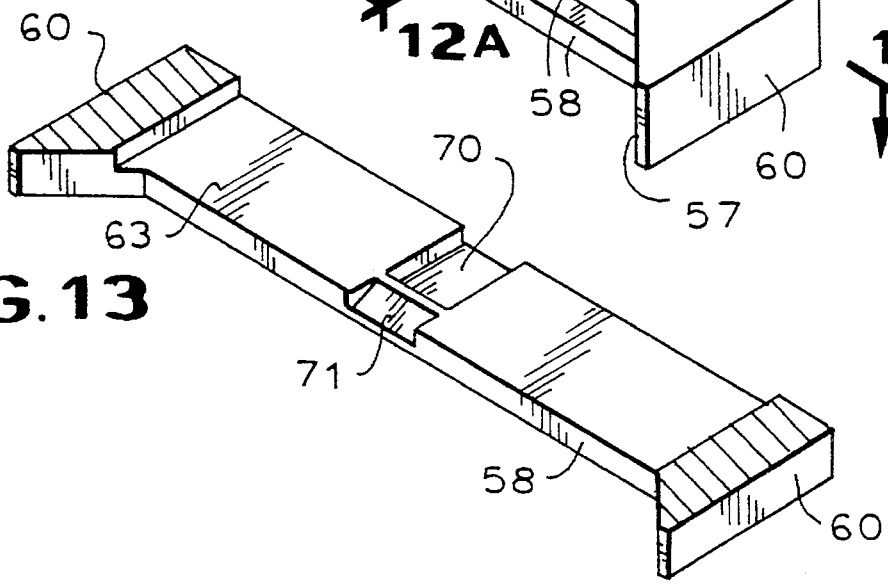
FIG. 13 is an isometric sectional view along lines 13—13 in FIG. 11.

Referring now to FIGS. 6A and 6B, the hanger 30 defines a hook generally designated 32 and adapted to engage a rail, rack or like supporting element (not shown), and a conventional body (not shown) adapted to support the garments or other articles on the hanger 30. The hook 32 in turn defines a support 36 for receiving and engaging an indicator according to the present invention. In the first embodiment of FIG. 6A, a single boss 38 projects outwardly from each side of the support means 36, each boss 38 being disposed centrally along the length of each side of the support means 36. In the second embodiment of FIG. 6B, bosses 38' are spaced apart outwardly from the support means 36' in non-opposing relation. The bosses 38 may be tapered (i.e., bevelled) to facilitate attachment of the indicator 50 as discussed below. Also, by bevelling the bosses 38 at the top and bottom, the indicator may be attached to and removed from the hanger with less effort, if desired.

The support means 36 is typically thinner than the remainder of the hook 32. Where the hanger is formed with thickened marginal portions 40 connected by thin webs 42, the support means 36 may simply be a portion of the hook 32 devoid of a thickened upper marginal portion so that it has the thickness of the web 42 (except for the bosses 38 extending therefrom). Preferably, the hook 32 defines the support means 36 at the top thereof and optionally includes a thickened portion or outwardly projecting ledge 44 immediately below and on each side of the support means 36 for connecting the thickened marginal portions 40 disposed on either side of the support means 36 and limiting downward movement of the indicator. Of course, the ledge 44 could be replaced by stops to limit the downward movement of the indicator. Or the indicator itself can be formed with stops.

The hanger 30 may be formed of any of the conventional materials used for garment hangers, typically a moldable material such as polystyrene. The thickness of the hanger, and especially the thickened marginal portions 40, will vary with the intended use of the hanger—e.g., the weight of the garments or other articles to be supported thereby. It will be appreciated that while the hanger is referred to herein as a garment hanger, the principles of the present invention apply equally to hangers for other articles where information regarding the other articles is to be communicated to the potential customer.

Additionally, while the hook 32 has been illustrated as having a constant web width or separation between the thickened marginal portions 40, so that there is no enlargement of the head of the hook 32, the principles of the present invention apply equally to hangers wherein the hook 32 has an enlarged head portion so that the top of the support means 36 extends higher than is shown (i.e., above the top contour of the hook) because of the greater width and/or height of the hook 32 in the region of the support means 36.

Referring now to FIGS. 3A, 3B, 3C and 5A, a first embodiment of an indicator according to the present invention for use with the hanger 30 of FIG. 6A is generally designated by the reference numeral 50. The indicator 50 is configured and dimensioned to be received and engaged by the hanger support means 36. Assuming the support means 36 is at the top of the hook 32, the indicator 50 is readily visible when the hanger 10 is in use by virtue of its position on the hook 32. More particularly, the indicator 50 includes a hollow four-sided body 52 defining an open top 54, an open bottom 56, a generally parallel pair of opposed sides 58 connecting the top and bottom 54, 56, and a generally parallel pair of opposed ends 60 connecting the sides 58 and typically also connecting the top and bottom 54, 56. Each side 58 has an outwardly facing, generally planar and unapertured side surface 62, and an inwardly facing side surface 63 and each end 60 has an outwardly facing, generally planar end surface 64. In the exemplary embodiment of the invention, the planar end surfaces 64 provide an ample area on which information 65 (e.g., "M" or "MEDIUM") may be molded or printed. The information 65 is preferably molded or printed onto both planar side and end surfaces 62, 64 so that the information is readily viewable from all sides of the indicator 50. Thus, even when the indicator-bearing hanger 30 is sandwiched on a rail between two other indicator-bearing hangers, the information 65 remains readily viewable from either end of the indicator 50 without removal of the hanger from the rail. In addition, information 65 may consist of a bar code or the like capable of being scanned by a bar code reader to provide for automated handling of hangers and garments or to enable inventory to be taken.

Figure 12A:
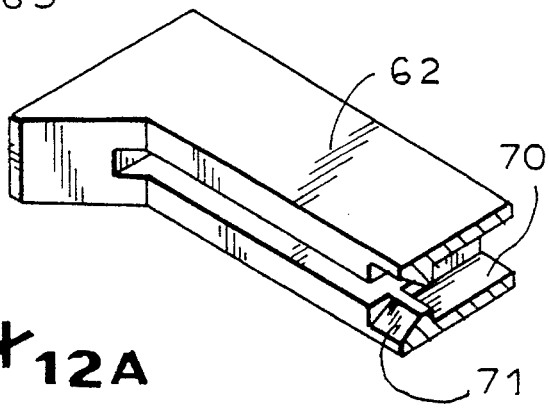
FIG. 12A is an isometric sectional view along lines 12A—12A in FIG. 11.
Figure 12B:
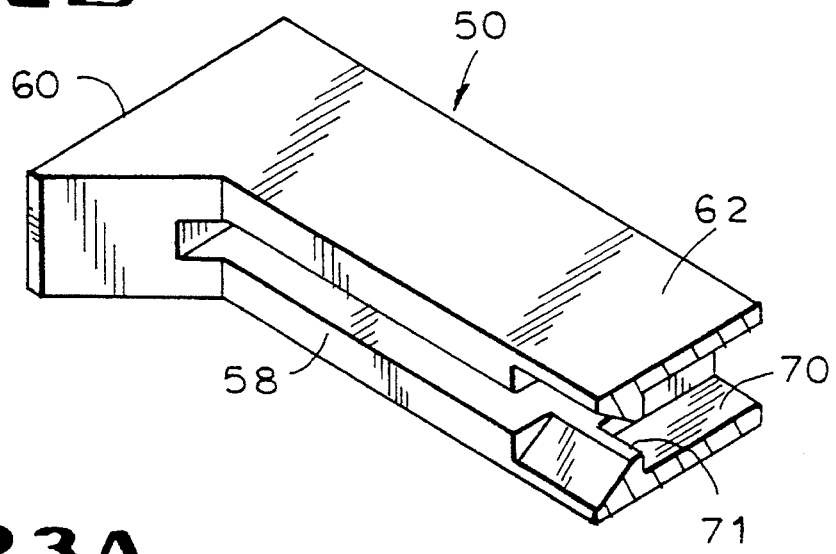
Figure 23A:
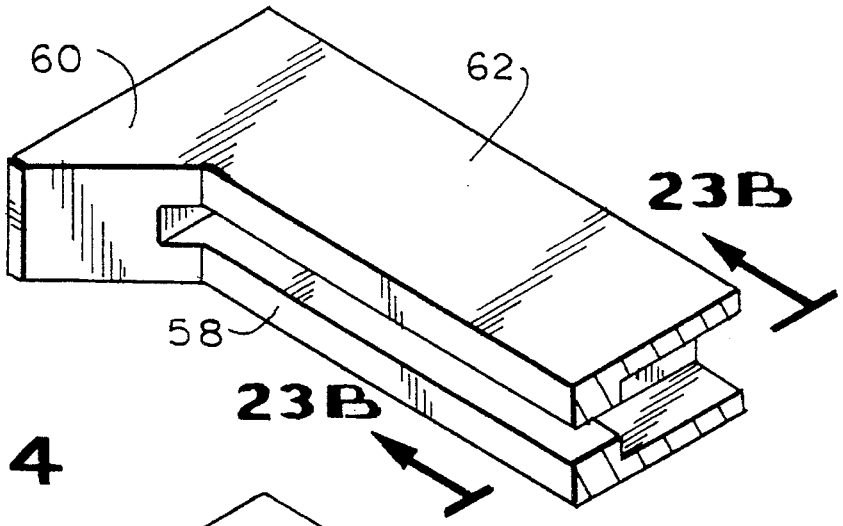
FIG. 23A is an isometric sectional view of the indicator shown in FIG. 15 having non-tapered surfaces.
Figure 24:
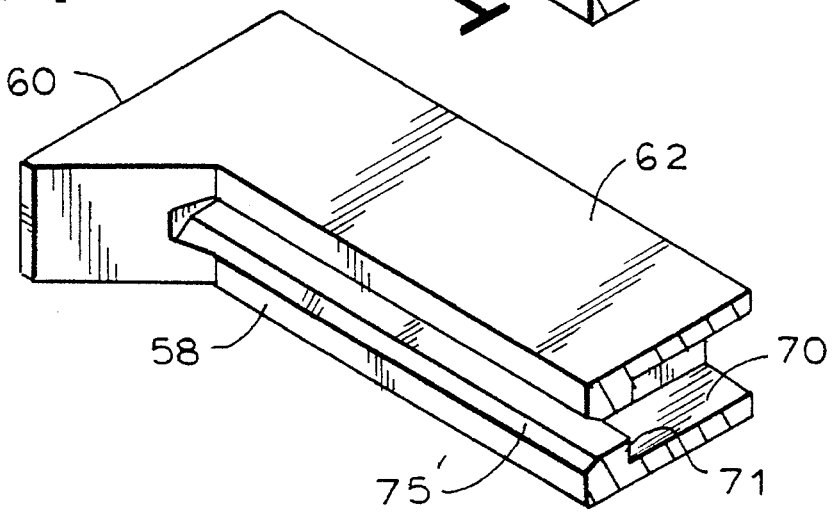
FIG. 24 is an isometric sectional view of an indicator having a slight-taper of the inner side surfaces thereof.
Figure 18A:
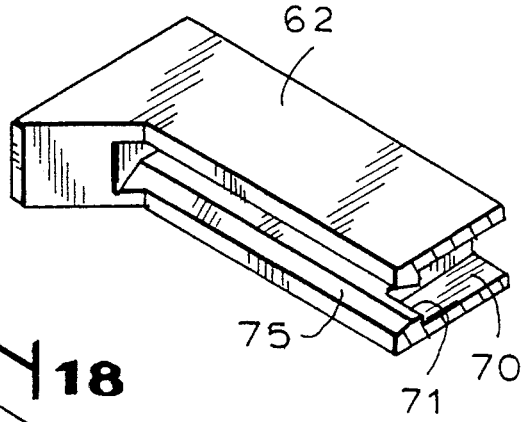
FIG. 18 is an isometric sectional view along lines 18—18 in FIG. 16.
Figure 16:
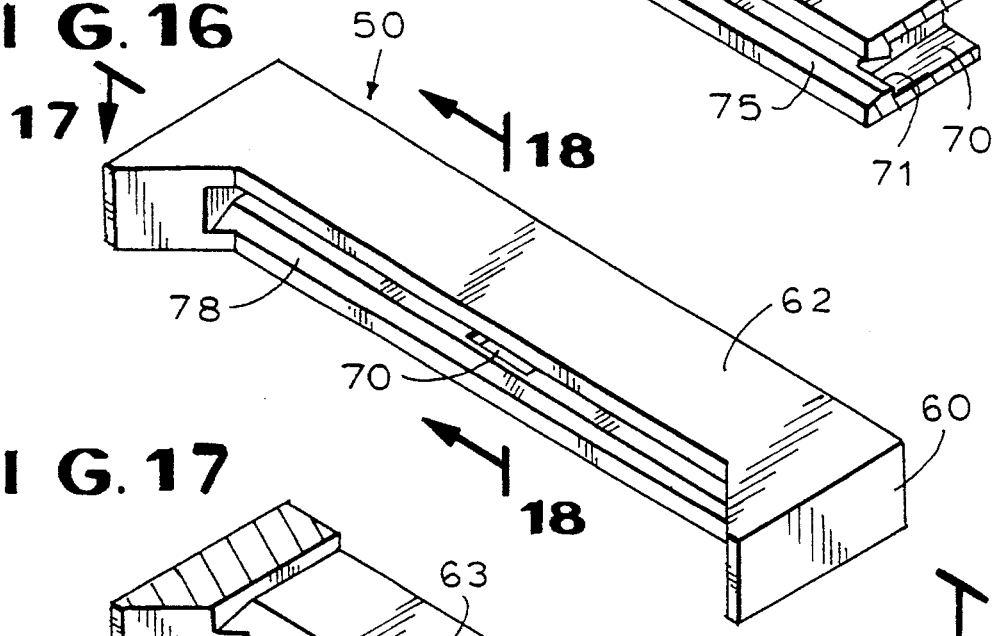
FIG. 16 is an isometric view of the indicator of FIG. 10 having a full length taper on each of the inner side surfaces.
Figure 17:
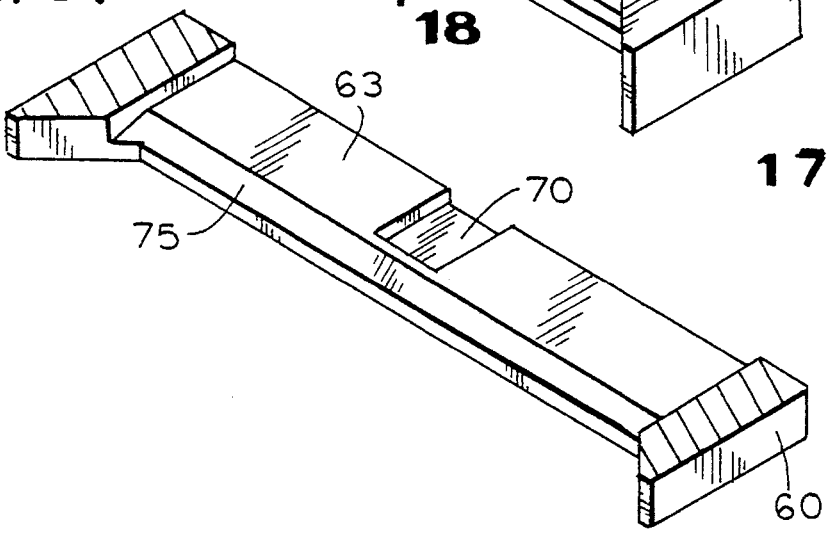
FIG. 17 is an isometric sectional view along lines 17—17 in FIG. 16.

Referring now to FIGS. 5A and 6A, in the first embodiment, to prevent accidental disengagement from the hanger 30, the indicator 50 is provided with at least one recess 70 formed in each inner side surface 63 of side 58 where each recess 70 is configured and dimensioned to receive therein the respective boss 38 of the support means 36 of the hanger hook 32 when the open bottom 56 of the indicator abuts the outwardly projecting, thickened portion or ledge 44 below the support means 36. Each recess 70 includes a shelf 71 which provides a retaining structure for interlocking with each boss 38 to secure the indicator 50 to the hanger 30. Shelf 71 may be tapered as shown in FIGS. 3B, 5A and 5B, or non-tapered as shown in FIG. 23B. The shelf 71 can have an extended, tapered lead-in as shown in FIG. 12B to account for misalignment. Alternatively, the entire inner side surface 63 of the indicator may be significantly tapered 75 as shown in FIGS. 16–18, or slightly tapered 75' as shown in FIG. 24, to regulate ease of installation on the hanger hook 36. Clearly, bosses 38 may be provided on each side of the support means 36, with a corresponding number of recesses 70 and associated shelves 71 formed in each inner side surface 63 of side 58 of the indicator. To prevent the indicator from being inadvertently installed upside down, the recesses 70 can be made to be of a length shorter than the height of the indicator body (FIGS. 3A, 3C and 5A), or separate stops (not shown) can be attached to the indicator in these areas if full length recesses are employed. Alternatively, FIGS. 10–15 depict full-length recesses 70 which form open slots in the top 54 of the indicator.

Referring now to FIGS. 4A, 4B and 5B in a second embodiment for use with the hanger 30' of FIG. 6B, the indicator 50' is provided with a pair of recesses 70 longitudinally spaced apart along the length of the indicator with respect to one another on the inner side surfaces 63 of sides 58. As in the first embodiment, the recesses 70 each include a shelf 71 for engaging a boss 38 of support means 36. Preferably, these recesses are positioned within the opposite sides 58 of the indicator at opposite locations somewhat between the center of the indicator and each of respective ends 60. The recesses may be open-ended at the top 54 of the indicator and can be formed in both inner side surfaces 63 in opposed relation as shown in the embodiment of FIGS. 19–22. Similar to the first embodiment, the respective shelves 71 may be individually tapered as shown for example in FIGS. 12A and 12B, or the entire inner side surfaces 63 may be tapered as shown in FIGS. 20–22. This configuration provides a superior connection to the support means 36 by reducing the tendency of the indicator 50 to otherwise rotate horizontally and/or vertically (i.e., rocking) as a result of a sloppy fit which can occur between the indicator 50 and support means 36.

In this regard, it will be appreciated that the engagement between the indicator 50 and the support means 36 may be improved in all embodiments by providing the bottom 56 of the indicator with tapered ends 57, which may be curved, by extending the length of ends 60 beyond the height of the indicator in the middle thereof. This extends the available surface area for the indicia and may be implemented in both embodiments. It will also be apparent to those skilled in the art that the depicted configuration of the recesses 70 and associated tapered shelves 71 is exemplary; the illustrated locations, number, and configuration of the recesses 70, although preferred, may be changed without departing from the scope of the invention.

As an optional way of facilitating detachability, the indicator sides 58 may be made sufficiently thin such that when the planar end surfaces 64 are grasped between the fingers, the sides 58 will flex enough to permit removal of the indicator from the hanger without the use of tools. However, since the top 54 of the indicator 50 is open and because there is some vacant space above the support means 36, a tool such as a screwdriver blade could be inserted through an unoccupied area of the open top 54 and between the indicator sides 58 and then rotated to cause the indicator sides 58 to bow outwardly and disengage from the hook bosses 38.

Referring now to FIGS. 7A, 8A and 9A, in a third embodiment of the invention, the indicator 50*a* is provided with a pair of bosses 38*a* which are centrally disposed and project inwardly from the inner side surfaces 63*a* of the indicator sides 58*a*. The hanger 30*a* includes a support 36*a* which defines a pair of centrally disposed recesses 70*a* and associated retaining shelves, 71*a* for engaging the respective bosses 38*a* of the indicator 50*a*. This embodiment is structurally analogous to and provides the same advantages as the first embodiment shown in FIGS. 3A, 3B and 5A.

Referring now to FIGS. 7B, 8B and 9B, in a fourth embodiment of the invention, the indicator 50*a'* defines a pair of bosses 38*a'* which are longitudinally disposed in non-opposing relation along the length of the indicator and project inwardly from the inner side surfaces 63*a'* of the indicator sides 58*a'*. In this regard, the hanger 30*a'* comprises a support 36*a'* which defines a pair of recesses 70*a'* and retaining shelves, 71*a'* for engaging the respective bosses 38*a'* of the indicator 50*a'*. This configuration is structurally analogous to and provides the same advantages as the second embodiment shown in FIGS. 4A, 4B and 5B.

Because the indicators 50 may be open-ended (i.e., note the open top and bottom 54, 56, see, e.g., FIGS. 3A and 3B), they may be inexpensively fabricated (e.g., of polyvinyl chloride or the like) by an extrusion process with subsequent machining of the recesses and shelves,, or the entire structure can be injection molded (e.g., of polystyrene or the like). It is to be understood that the indicators 50 need not be open-ended and that closed-ended indicators are considered to be within the scope of the invention, as such a configuration does not adversely affect the utility of the indicators.

While the indicator ends 60 have been described as generally parallel with outwardly facing generally planar end surfaces 64, a limited degree of variation in the parallel nature of the ends and the planarity of the end surfaces is possible in order to provide further benefits. For example, the planar end surfaces 64 may be formed having a slightly concave profile to more readily facilitate grasping. The degree of concavity should not interfere, however, with the printing or molding of information on the indicator end surfaces 64.

To summarize, the present invention provides an indicator-and-hanger combination wherein the indicator can be securely attached to the hanger. In a preferred embodiment the indicator is readily visible when the hanger is in view by virtue of its position on the hook, and the information regarding the articles is disposed both on the side and end surfaces of the indicator for sufficient visibility, even when the hanger is on a rack with like hangers on either side thereof. The combination is inexpensive to manufacture and maintain and simple to use.

The present invention has been shown and described in what are considered to be the most practical and preferred embodiments. It is anticipated, however, that departures can be made therefrom and that obvious modifications will be implemented by persons skilled in the art.

We claim:

1. In combination, a hanger for garments and other articles, and an indicator tab securable to said hanger for indicating information associated with the article;

said hanger defining a hook for engaging a rail or other structure, said hook including a support for receiving said indicator and also including means for engaging said indicator; and said indicator being receivable on said support, said indicator including a substantially hollow four-sided body defining an open top, an open bottom, a generally parallel pair of opposed sides connecting said top and bottom, and a generally parallel pair of opposed ends connecting said sides, each of said sides having a generally planar and unapertured outer side surface for displaying the information and an inner side surface, at least one of said inner side surfaces including means for interlocking with said engaging means of said hanger hook to secure said indicator to said hook when said indicator is received on said support and each of said sides being configured and dimensioned to resiliently bow outwardly such that said indicator is engageable with or disengageable from said support by causing at least one of said sides to bow outwardly relative to said support.

2. The combination hanger and indicator as recited in claim 1, wherein said engaging means defines at least one boss projecting outwardly from at least one opposed side of said hook, and said means for interlocking with said engaging means comprises a retaining shelf projecting inwardly from said inner side surface of said indicator.

3. The combination hanger and indicator as recited in claim 1, wherein said inner side surfaces of said indicator each define at least one recess, where said recess on each of said inner side surfaces are disposed longitudinally with respect to each other along the length of the indicator in non-opposing relation.

4. The combination hanger and indicator recited in claim 1, wherein each of said planar outer side surfaces and each of said planar end surfaces include indicia bearing information.

5. The combination hanger and indicator as recited in claim 4, wherein said indicia is unitarily molded into said side surfaces and said end surfaces.

6. The combination hanger and indicator as recited in claim 4, wherein said indicia is printed on said side surfaces and said end surfaces.

7. The combination hanger and indicator as recited in claim 1, wherein at least one of said outer side surfaces and said planar end surfaces includes indicia capable of being scanned by a bar code reader apparatus.

8. A combination hanger for garments and other articles, and an indicator securable to said hanger for indicating information associated with the articles;

said hanger defining a hook for engaging a rail or other structure, said hook including a support for receiving said indicator and also including means for engaging said indicator, said means for engaging defining at least one boss projecting outwardly from at least one opposed side of said hook; and said indicator being receivable on said support, said indicator including a substantially hollow four-sided body defining an open top, an open bottom, a generally parallel pair of opposed sides connecting said top and bottom, and a generally parallel pair of opposed ends connecting said sides, each of said sides having a generally planar outer side surface and an inner side surface, at least one of said inner side surfaces defining at least one elongated recess including means for interlocking with said engaging means of said hanger hook to secure said indicator to said hook when said indicator is received on said support, said means for interlocking comprising a tapered retaining shelf associated with said recess and each of said sides being configured and dimensioned to resiliently bow outwardly such that said indicator is engageable with or disengageable from said support by causing at least one of said sides to bow outwardly relative to said support.

9. The combination hanger and indicator as recited in claim 8, wherein said recesses are disposed longitudinally with respect to each other along the length of the indicator.

10. The combination hanger and indicator as recited in claim 8, wherein each of said planar outer side surfaces and each of said planar end surfaces include indicia bearing information.

11. A combination hanger for garments and other articles, and an indicator securable to said hanger for indicating information associated with the articles;

said hanger defining a hook for engaging a rail or other structure, said hook including a support for receiving said indicator and also including means for engaging defining at least one boss projecting outwardly from at least one opposed side of said support; and said indicator being receivable on said support, said indicator including a hollow four-sided body defining an open top, an open bottom, a generally parallel pair of opposed sides connecting said top and bottom, and a generally parallel pair of opposed ends connecting said sides, each of said sides having a generally planar outer side surface and an inner side surface, said inner side surfaces respectively defining at least one recess including means for interlocking with said engaging means of said hanger hook to secure said indicator to said hook when said indicator is received on said support, where said recesses defined in said inner side surfaces are disposed longitudinally along the length of the indicator with respect to each other and each of said sides being configured and dimensioned to resiliently bow outwardly such that said indicator is engageable with or disengageable from said support by causing at least one of said sides to bow outwardly relative to said support.

12. A combination hanger for garments and other articles, and an indicator securable to said hanger for indicating information associated with the articles;

said indicator including a substantially hollow four-sided body defining an open top, an open bottom, a generally parallel pair of opposed sides connecting said top and bottom, and a generally parallel pair of opposed ends connecting said sides, each of said sides having a generally planar outer side surface and an inner side surface, at least one of said inner side surfaces defining means for engaging said hanger; and said hanger defining a hook for engaging a rail or other structure, said hook including a support for receiving said indicator and also including means for retaining said indicator, said retaining means for interlocking with said engaging means of said indicator to secure said indicator to said hook when said indicator is received on said support and each of said sides of said indicator being configured and dimensioned to resiliently bow outwardly such that said indicator is engageable with or disengageable from said support by causing at least one of said sides to bow outwardly relative to said support.

13. The combination hanger and indicator as recited in claim 12, wherein said retaining means of said hanger comprises at least one recess defined in said hook and includes means for interlocking with said engaging means of said indicator.

14. The combination hanger and indicator as recited in claim 13, wherein said means for interlocking comprises a tapered shelf associated with said recess defined in said hook.

15. The combination hanger and indicator as recited in claim 12, wherein said retaining means of said hanger are longitudinally disposed on opposite sides of said hook in non-opposing relation along the length of said hook, and said engaging means of said indicator are longitudinally disposed in non-opposing relation along the length of said indicator in correspondence to said retaining means.

16. The combination hanger and indicator as recited in claim 12, wherein said engaging means comprises at least one boss projecting inwardly from said inner side surface of at least one of said sides of said indicator for securing said indicator to said hanger.

* * * * *